United States Patent [19]

Takahashi et al.

[11] 4,372,805

[45] Feb. 8, 1983

[54] METHOD FOR REGENERATING AN ETCH SOLUTION FOR ALUMINUM AND THE ALLOYS THEREOF

[76] Inventors: Masaaki Takahashi, c/o Toyo Giken Kogyo Co., Ltd., 19-17, Kaminarimon 2-chome, Taito-ku, Tokyo; Hideki Hamamura, 7-9, Kishibeminami 2-chome, Suita, Osaka, both of Japan

[21] Appl. No.: 334,467

[22] Filed: Dec. 28, 1981

[30] Foreign Application Priority Data

Aug. 10, 1981 [JP] Japan ..... 56-125499

[51] Int. Cl.[3] ..... C23F 1/00; B44C 1/22; C03C 15/00; C03C 25/06

[52] U.S. Cl. ..... 156/642; 156/665; 252/79.5

[58] Field of Search ..... 156/345, 642, 665; 252/79.5; 75/108, 109; 134/10, 13

[56] References Cited

U.S. PATENT DOCUMENTS 3,607,482 9/1971 Selm ..... 156/642
4,136,026 1/1979 Meyer et al. ..... 156/642 X

FOREIGN PATENT DOCUMENTS 54-9014585 6/1979 Japan ..... 156/642

*Primary Examiner*—William A. Powell

*Attorney, Agent, or Firm*—Benasutti Associates, Ltd.

[57] ABSTRACT

An etch solution for aluminum and the alloys thereof, after being used in caustic etching is regenerated, without using a large amount of heat energy for the concentration of the solution and without causing the accumulation of impurities in the etch solution, by (a) diluting at least a portion of an etch solution, after being used in caustic etching of aluminum or the alloys thereof, containing 100 through 240 g/l of free sodium hydroxide and 30 through 200 g/l of dissolved aluminum which is in an unsaturated state, as aluminum hydroxide, or in a similar condition by adding water in an amount of 0.5 through 2.5 times by volume based on the volume of the etch solution to be diluted, whereby the solution containing aluminum hydroxide at a supersaturated state is formed;

(b) hydrolyzing the excess aluminum dissolved in the solution to crystallize aluminum hydroxide out of the solution;

(c) separating the crystallized aluminum hydroxide from the solution; and (d) concentrating the resultant liquid to such an extent that the concentration of free sodium hydroxide is within the range of from 110 to 300 g/l, whereby the concentrated solution is reused as an etch solution.

4 Claims, 2 Drawing Figures

METHOD FOR REGENERATING AN ETCH SOLUTION FOR ALUMINUM AND THE ALLOYS THEREOF

BACKGROUND OF THE INVENTION

1. Field of the Invention

The present invention relates to a method for regenerating a caustic (or alkali) etch solution after being used in the caustic etching of aluminum and the alloys containing, as a main constituent, aluminum such as duralumin (which is referred to as "aluminum and the alloys thereof" hereinbelow).

2. Description of the Prior Art

In the case where aluminum and the alloys thereof are anodized, caustic etching using an aqueous sodium hydroxide solution is generally carried out as a pretreatment. During the etching, since aluminum is dissolved into the etch solution in the form of sodium aluminate, the concentration of the free sodium hydroxide decreases with as the etching proceeds, and finally, etching becomes impossible. The etching waste liquid thus formed has been neutralized heretofore, and large amounts of sludge generally having a high water content are generated and cause environmental pollution. Furthermore, the regeneration of the caustic etch solution has been heretofore carried out by partially using the principle of the Bayer method. However, this regeneration is only effective in the case where the etch solution already contains aluminum hydroxide in a supersaturated condition. However, in the case where the aluminum hydroxide is contained in the etch solution in an unsaturated condition or a slightly supersaturated condition, the regeneration can not be satisfactorily effected.

Recently, Japanese Patent Publication No. 51-22901/1976 has disclosed a new method in which, by utilizing the principle of the Bayer method, a etch solution is first diluted with water to thereby precipitate aluminum hydroxide and the resultant liquid is separated and concentrated and, then, the concentrated liquid is returned to an etching vessel. However, since the etch solution is diluted with a large amount of a washed water (i.e. 3–8 times by volume) to recover the sodium hydroxide which is discharged into the washed water, an extremely large amount of heat energy is required for the concentration of the diluted etch solution, and, therefore, this method is not advantageous from an economical point of view. Furthermore, the prevention of the accumulation of impurities in the system due to the circulation of the recovered etch solution is not taken into account.

SUMMARY OF THE INVENTION

An object of the present invention is to obviate the above-mentioned problems of the prior arts and to provide a method for regenerating an etch solution for aluminum and the alloys thereof without using a large amount of heat energy for the concentration of the diluted etch solution.

Another object of the present invention is to provide a method for regenerating an etch solution for aluminum and the alloys thereof without causing an accumulation of impurities in the etch solution.

Other objects and advantages of the present invention will be apparent from the description set forth hereinbelow.

In accordance with the present invention, there is provided a method for regenerating an etch solution for aluminum and the alloys thereof comprising the steps of:

(a) diluting at least a portion of an etch solution, after being used in caustic etching of aluminum and the alloys thereof, containing 100 through 240 g/l of free sodium hydroxide and 30 through 200 g/l of dissolved aluminum which is in an unsaturated state, as aluminum hydroxide or in a similar condition (or in an almost unsaturated condition) by adding water in an amount of 0.5 through 2.5 times by volume based on the volume of the etch solution to be diluted, whereby the solution containing aluminum hydroxide at a supersaturated state is formed;

(b) hydrolyzing the excess aluminum dissloved in the solution to crystallize aluminum hydroxide out of the solution;

(c) separating the crystallized aluminum hydroxide from the solution; and (d) concentrating the resultant liquid to such an extent that the concentration of free sodium hydroxide is within the range of from 110 to 300 g/l, whereby the concentrated solution is reused as an etch solution.

In accordance with the present invention, there is also provided a method for regenerating an etch solution for aluminum and the alloys thereof comprising the steps of;

(a) removing the solid sulfides of metals and the solid hydroxides of metals other than aluminum from at least a portion of an etch solution, after being used in caustic etching of aluminum and the alloys thereof, containing 100 through 240 g/l of free sodium hydroxide, 50 g/l or less of sodium sulfide and 30 through 200 g/l of dissolved aluminum and containing aluminum hydroxide in an unsaturated state or in a similar condition.

(b) diluting the resultant solution by adding water in an amount of 0.5 through 2.5 times by volume based on the volume of the solution to be diluted, whereby the solution containing aluminum hydroxide at a supersaturated state is formed;

(c) hydrolyzing the excess aluminum dissolved in the solution to crystallize aluminum hydroxide out of the solution;

(d) separating the crystallized aluminum hydroxide from the solution; and (e) concentrating the resultant liquid to such an extent that the concentration of free sodium hydroxide is within the range of from 110 to 300 g/l, whereby the concentrated solution is reused as an etch solution.

BRIEF DESCRIPTION OF THE DRAWINGS

The present invention will be better understood from the description set forth below with reference to the accompanying drawings, in which.

According to the method of the present invention, aluminum and the alloys thereof are subjected to caustic etching with an etch solution containing sodium hydroxide, and in the case where the concentration of free sodium hydrooxide in the etch solution reaches 100–240 g/l and where the concentration of dissolved aluminum reaches 30–200 g/l, a portion or all of the etch solution is withdrawn. By the term "free sodium hydroxide" is meant stoichiometrically excess sodium hydroxide. That is to say, $$\text{(Free Sodium Hydroxide Concentration)} = \text{(Total Sodium Hydroxide Concentration)} - \text{(Dissolved Aluminum Concentration)} \times \frac{40}{27}$$

wherein total sodium hydroxide concentration is determined by subtracting the sodium concentration derived from sodium sulfide from the total sodium concentration and assuming that the dissolved aluminum is in the form of sodium aluminate. Thus, "free sodium hydroxide" concentration is determined by subtracting the bonded sodium of sodium aluminate from the total hydroxide concentration.

To the withdrawn etch solution, optionally after removing impurities such as solid sulfide, water is added, in an amount of 0.5 through 2.5 times by volume based on the volume of the withdrawn etch solution and, then, is hydrolyzed at an appropriate temperature, desirably at a temperature of 40° through 70° C., to crystallize the aluminum hydroxide. The crystallized aluminum hydroxide is separated from the alkaline liquid by means of a solid-liquid separation method. The resultant alkaline liquid is concentrated until the concentration of free sodium hydroxide comes within the range of from 110 through 300 g/l. Thus, the concentrated liquid can be advantageously reused as an etch solution.

Figure 1:
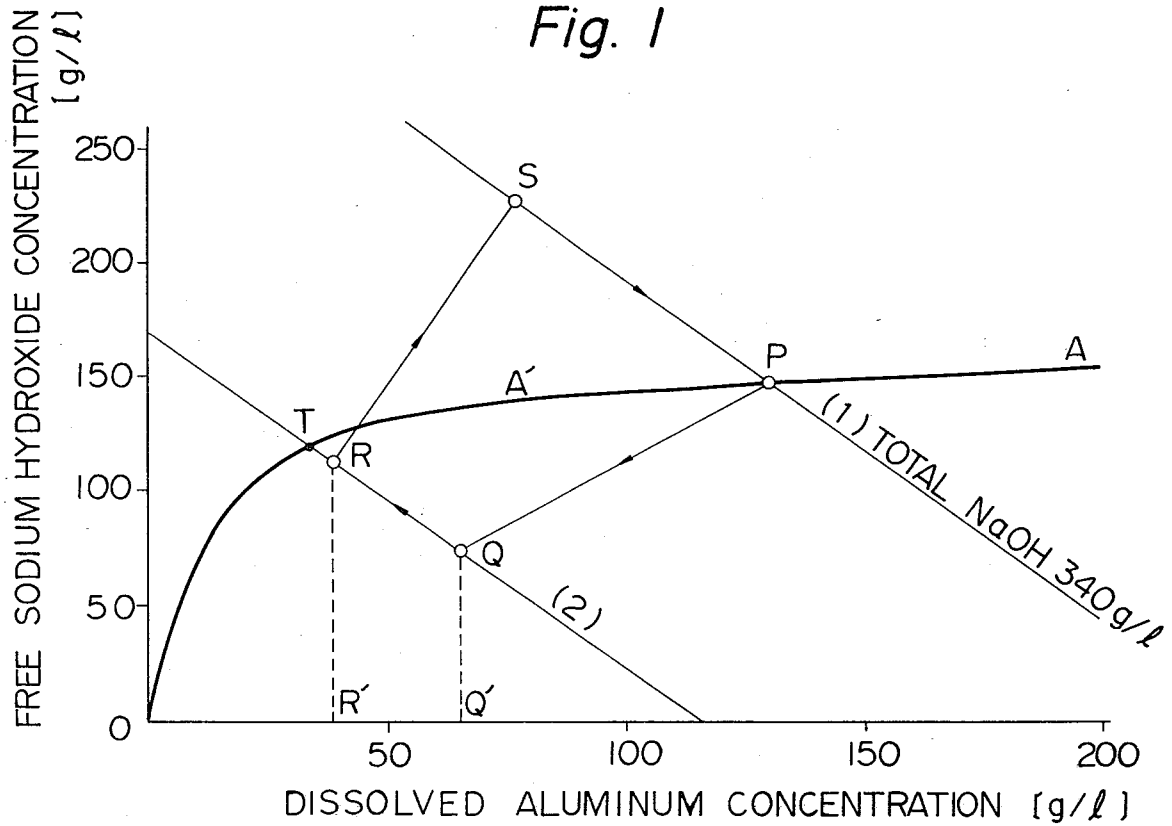
FIG. 1 is an equilibrium diagram illustrating the correlation of sodium hydroxide-aluminum hydroxide-water system at a temperature of 60° C., in which an example of the cycle of the regeneration steps is shown as P→Q→R→S→p.

In FIG. 1, a correlation of sodium hydroxide-aluminum-hydroxide-water system at a typical temperature of 60° C. In FIG. 1, the concentration of free sodium hydroxide is shown in the ordinate axis and the concentration of dissolved aluminum is shown in the abscissa axis. The saturated solubility of aluminum hydroxide is shown by the curve OA′ A. The area above the curve OA′ A shows a homogeneous liquid phase of free sodium hydroxide and sodium aluminate, and the area below the curve OA′ A shows a heterogeneous phase in which a liquid phase comprising free sodium hydroxide and sodium aluminate and a solid phase of aluminum hydroxide coexist. The state in which the concentration of the total sodium hydroxide is constant is shown by, for example, a straight line (1) or (2). Even in the case where sodium sulfide is present, the saturated solubility of the aluminum hydroxide is not affected as long as the concentration of the sodium sulfide is 50 g/l or less.

For instance, assuming that an etch solution having a composition shown by point P is withdrawn for regeneration, when the etch solution is diluted twice with water, the composition of the diluted solution is changed to that shown by point Q in accordance with a so-called gravity center law. However, the liquid having a composition represented by point Q is a heterogeneous phase and, therefore, theoretically speaking, aluminum hydroxide is crystallized due to the hydrolysis from point Q to point T, which is the point of intersection of a constant total sodium hydroxide concentration line (2) and saturated curve OA′ A, whereby the concentration of the dissolved aluminum can be decreased. However, practically and industrially, point R before point T is a final point of operation in view of the retention time. The amount of the aluminum hydroxidecrystallized according to this operation is that corresponding to the reference in the concentration of the dissolved aluminum represented by the horizontal distance Q′–R′ of the line Q–R. Accordingly, as line Q–R is long, the amount of the aluminum hydroxide crystallized increases and the regeneration of the etch solution improves.

As is clear from the drawing, as the composition of the etch solution to be regenerated (i.e. the location of point P) is moved to the right-hand and bottom side of the drawing, the amount of the aluminum hydroxide crystallized when diluted increases. However, in view of the chemical reaction, the etch rate, decreases in accordance with the decrease of concentration of free sodium hydroxide and the precitation of the aluminum hydroxide occurs in an etching tank and, therefore, the etching operation can not be actually effected. For this reason, the composition range of the etch solution which can be advantageously treated by the present invention, is that in which the point P is in the area of the saturation curve OA′ A or in the area above the curve OA′ A, desirablly, that having a free sodium hydroxide concentration of 100 through 240 g/l and a dissolved aluminum concentration of 30 through 200 g/l.

In the case where the etch solution having a composition of the point P of the above-mentioned range is diluted with water, and aluminum hydroxide is crystallized, it is apparent from FIG. 1 that the use of the water in an amount of 0.5 through 2.5 times by volume based on the volume of the etch solution to be diluted is most effective.

The aluminum hydroxide thus crystallized is separated from the liquid by means of, for example, a centrifugal separation, a vacuum dehydration and the like. An alkaline liquid is recovered from the separated filtrate, or from a crystallizer as a supernatant, and, then, is concentrated in an evaporator. The locus of condensing operation in FIG. 1 is shown by the line R–S in accordance with the gravity center law. The composition of the regenerated liquid becomes, for example, that of the point S depending upon the amount of the water vaporized. The regenerated liquid having a composition of the point S is mixed with an original aged solution in an etching tank, with or without the addition of supplying chemicals and, therefore, the composition is changed along the total sodium hydroxide concentration constant line (1). As a result, in the case of a batchwise operation, the composition of the etch solution is finally returned to point P by the etching of aluminum or the alloys thereof. On the other hand, in the case of a continuous operation, the addition of the etch solution having a composition of the point S, the etching of aluminum and the alloys thereof and the withdrawing of the etch solution are simultaneously or concurrently carried out, so that the composition of the etch solution is maintained at a constant state at the point P in principle.

FIG. 1 illustrate the correlation at a temperature of 60° C. Accordingly, in the case where the temperature is increased, the saturated curve OA′ A is somewhat moved to a lower direction, whereas in the case where the temperature is decreased, the saturated curve OA′ A is somewhat moved to an upper direction. However, the desirable temperature range of 40° through 70° C. of the present invention, no substantial change is caused in the operation of the present invention.

In the case where the etch solution is circulated and reused, impurities which are contained in the aluminum and the alloys thereof and which are soluble in an aqueous sodium hydroxide solution are necessarily accumulated in the etch solution and, as a result, the finish of the etching of aluminum and the alloys thereof deteriorates. Examples of such impurities are copper, zinc, chromium and the like. However, this problem can be ovbiated by the use of sodium sulfide in the etch solution in an amount of 50 g/l or less. That is to say, the above-mentioned impurities can be precipitated and removed from the etch solution by converting the impurities to the sulfide solid by the addition of sodium sulfide. In order to settle the sulfides, polymeric flocculants such as partially hydrolyzed polyacrylamide, polyethyleneimine and the like can be advantageously used, whereby the settling rate is increased and the removal of the sulfides is facilitated.

Figure 2:
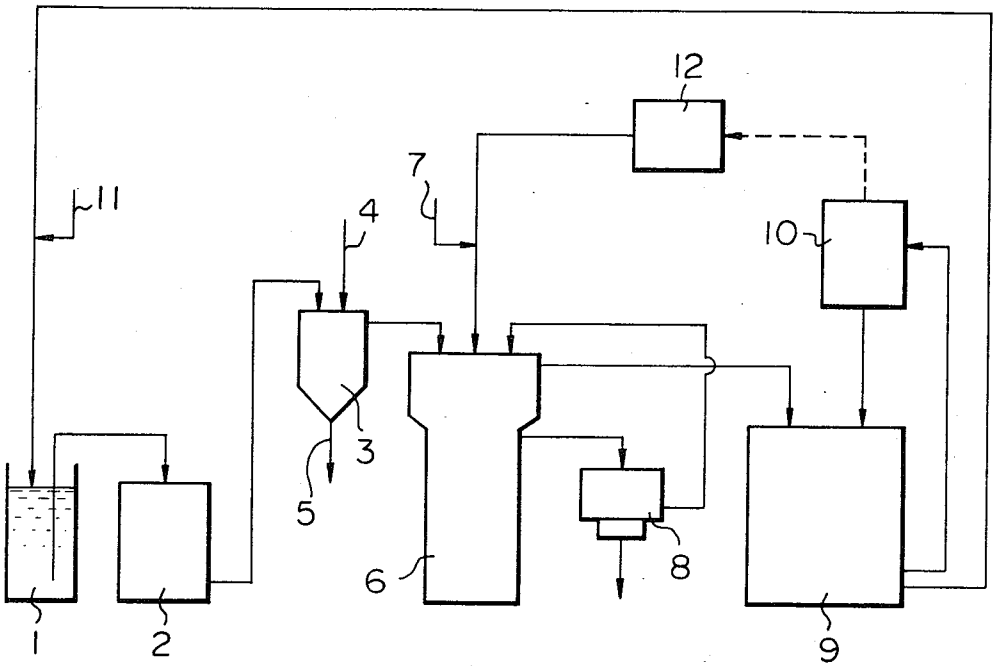
FIG. 2 is a schematic drawing illustrating an example of the present invention.

Referring to FIG. 2, in which one typical example of the regeneration steps of a caustic etch solution for aluminum and the alloys thereof is illustrated, a portion of an etch solution in an etching tank 1 was withdrawn from a reservoir 2. To the etch solution, a polymeric flocculant was added from a line 4 in a thickener 3. The settled solid sulfide were removed from a nozzle 5. A supernatant liquid of the thickener 3 was introduced to a crystallizer 6, wherein diluting water was added from a line 7. Thus, aluminum hydroxide was crystallized. The aluminum hydroxide thus crystallized was separated and removed by circulating a portion of the liquid in the crystallized 6 through a centrifugal separator 8. The alkaline liquid which was discharged from the crystallizer 6 as an overflown supernatant and which contained a decreased concentration of the dissolved aluminum was introduced in to a recovery tank 9. The alkaline liquid in the recovery tank 9 was concentrated by an evaporator 10. The concentrated liquid thus obtained was returned, with or without the addition of supplying sodium hydroxide and/or sodium sulfide 11 to the etching tank 1. The vaporized steam from the evaporator 10 was condensed in a condenser 12 and reused as diluting water in the system.

The temperature of the etch solution in the reservoir 2 was 95° C. and the composition thereof was as follows.

| | |
|---|---|
| Total sodium hydroxide | 340 g/l |
| Free sodium hydroxide | 147.4 g/l |
| Dissolved aluminum | 130 g/l |
| Sodium sulfide | 7.8 g/l |
| Sulfides metals | 7 g/l |

The temperature of the alkaline liquid in the crystallizer 6 was 60° C. and the composition thereof was as follows:

| | |
|---|---|
| Total sodium hydroxide | 170 g/l |
| Free sodium hydroxide | 113 g/l |
| Dissolved aluminum | 38.5 g/l |
| Sodium sulfide | 3.9 g/l |

The alkaline liquid contained 15 through 30% by weight of seed crystals and crystallized aluminum hydroxide. About 41% by weight of the introduced aluminum was hydrolyzed to sodium hydroxide and separated by the centrifugal separator. The aluminum hydroxide thus separated was crystalline aluminum hydroxide having good properties and the water content thereof was 15% by weight. The composition of the regenerated etch solution in the recovered tank 9 was as follows.

| | |
|---|---|
| Total sodium hydroxide | 325 g/l |
| Free sodium hydroxide | 215.9 g/l |
| Dissolved aluminum | 73.6 g/l |
| Sodium sulfide | 7.5 g/l |
| Sulfides of metals | 0 g/l |

The recovery efficiency of the effective component per 1 cycle was 86.7%. This value can be increased by means of dehydration of waste settled solid sulfide to reclaim its filtrate.

As explained hereinabove, according to the present invention, a caustic etch solution for aluminum and the alloys thereof can be effectively regenerated and recovered. In addition to the above, crystalline aluminum hydroxide having good properties, which is capable of being utilized various fields such as absorbents, abrasives and the like can be simultaneously recovered as a by-product.

We claim:

1. A method for regenerating an etch solution for aluminum and the alloys thereof comprising the steps of:

(a) diluting at least a portion of an etch solution, after being used in caustic etching of aluminum and the alloys thereof, containing 100 through 240 g/l of free sodium hydroxide and 30 through 200 g/l of dissolved aluminum which is in an unsaturated state, as aluminum hydroxide, or in a similar condition by adding water in an amount of 0.5 through 2.5 times by volume based on the volume of the etch solution to be diluted, whereby the solution containing aluminum hydroxide at a supesaturated state is formed;

(b) concentrating the resultant liquid to such an extent that the concentration of free sodium hydroxide is within the range of from 110 to 300 g/l, whereby the concentrated solution is reused as an etch solution.

2. The method as claimed in claim 1, wherein the hydrolysis is effected at a temperature of 40° through 70° C.

3. A method for regenerating an etch solution for aluminum and the alloys thereof comprising the steps of:

(a) removing the solid sulfides of metals and the solid hydroxides of metals other than aluminum from at least a portion of an etch solution, after being used in caustic etching of aluminum and the alloys thereof, containing 100 through 240 g/l of free sodium hydroxide, 50 g/l or less of sodium sulfide and 30 through 200 g/l of dissolved aluminum and containing aluminum hydroxide in an unsaturated state or in a similar condition;

(b) diluting the resultant solution by adding water in an amount of 0.5 through 2.5 times by volume based on the volume of the solution to be diluted, whereby the solution containing aluminum hydroxide at a supersaturated state is formed;

(c) hydrolyzing the excess aluminum dissolved in the solution to crystallize aluminum hydroxide out of the solution;

(d) separating the crystallized aluminum hydroxide from the solution; and (e) concentrating the resultant liquid to such an extent that the concentration of free sodium hydroxide is within the range of from 110 to 300 g/l, whereby the concentrated solution is reused as an etch solution.

4. The method as claimed in claim 3, wherein the hydrolysis is effected at a temperature of 40° through 70° C.

* * * * *